United States Patent [19]

Dieringer

[11] Patent Number: 4,765,081

[45] Date of Patent: Aug. 23, 1988

[54] FIREARM MAGAZINE AND METHOD FOR PREVENTING THE SHELLS FROM JAMMING

[76] Inventor: Dale E. Dieringer, 7720 Teller St., Arvada, Colo. 80003

[21] Appl. No.: 52,232

[22] Filed: May 20, 1987

[51] Int. Cl.[4] ..... F41C 25/02

[52] U.S. Cl. ..... 42/50

[58] Field of Search ..... 42/50, 7, 18, 22

[56] References Cited

U.S. PATENT DOCUMENTS

| | | | |
|---|---|---|---|
| 2,777,235 | 1/1957 | Hopkins | 42/50 |
| 3,087,270 | 4/1963 | Stoner | 42/50 |
| 3,577,860 | 5/1968 | Jestrabek | 42/50 |
| 4,127,954 | 12/1978 | Hausmann | 42/50 |
| 4,366,638 | 1/1983 | Ketterer et al. | 42/50 |
| 4,509,283 | 4/1985 | Chesnut | 42/50 |
| 4,580,364 | 4/1986 | Vyprachticky et al. | 42/50 |

FOREIGN PATENT DOCUMENTS

| | | | |
|---|---|---|---|
| 635534 | 11/1963 | Belgium | 42/50 |
| 406904 | 8/1966 | Switzerland | 42/50 |

*Primary Examiner*—Charles T. Jordan
*Attorney, Agent, or Firm*—Edwin L. Spangler, Jr.

[57] ABSTRACT

The invention relates to an improvement in a multiple-shell weapon magazine or clip of the type employing either one or a pair of transversely-curved negator springs fastened to a particular sidewall of the cartridge chamber alongside the stack to lift the shells one-at-a-time through the open top thereof on a follower which is characterized by the spring or springs being so arranged and sized that the rearmost incurled edge of one seats within the annular grooves encircling the rear ends of the shells in the stack while the foremost incurled edge of the same or another spring curls around the bullets thereby alleviating any undue pressure applied to the shell casings by the medial portion of one spring or the adjacent edges of the pair that otherwise could cause the stack to jam. The invention also encompasses the method of preventing the shells from jamming in such a magazine by sizing and positioning the spring edges in the manner aforementioned.

10 Claims, 2 Drawing Sheets

FIREARM MAGAZINE AND METHOD FOR PREVENTING THE SHELLS FROM JAMMING

BACKGROUND OF THE INVENTION

Magazines carrying several rounds of ammunition have been used for many years to increase the fire power of a particular weapon. Some magazines are built into the weapon itself while others comprise a detachable accessory. Several magazines are made of plastic while others, especially those used by the military, are fabricated from metal. Both types use one or more springs attached to a follower to push the shells one-at-a-time up into position to be picked up by the bolt and shoved into the breech end of the barrel.

By far the majority of these magazines use some type of helical compression spring to advance the follower. Such springs have serious drawbacks in that the coils must stack atop one another thus taking up space in the bottom of the magazine that could otherwise be used to advantage for additional shells. They also need the bottom wall of the magazine as a fixed abutment to push against as they raise the follower and the shells stacked thereabove. Removing the bottom wall to clean or otherwise service the magazine, therefore, becomes somewhat of a problem in that the springs press against it constantly and they along with the follower come out once the wall has been removed. Reassembly is difficult for the same reasons.

An ideal solution would seem to lie in the use of so-called "negator" constant force springs which coil spirally instead of helically. By fastening one end of such a spring to the top of the magazine and letting the coil sit underneath the follower raising it upward as it recoils, several of the problems inherent in the use of helical springs for this purpose are overcome. To begin with, when the follower is at the bottom of the magazine and it is full of shells, the spring or springs are uncoiled so they take up very little space in the bottom thus enabling the magazine to carry additional shells. Moreover, since the springs are anchored at the top of the magazine and are, therefore, functionally independent of the bottom wall, the latter can easily be removed for cleanout while leaving the spring/follower subassembly intact.

If negator springs are so superior to helical ones for this application, the question naturally arises as to why the helical type is used at all. The answer, unfortunately, is that there is insufficient space alongside the stack of shells to accommodate negator springs when the magazine is designed for insertion into the handle of the weapon as opposed to one located underneath the receiver which is not particularly limited insofar as thickness is concerned. A helical spring positioned underneath the stack of shells, on the other hand, does not have to fit between the shell stack and magazine sidewall.

A further and even more difficult problem arises because the negator springs are not flat when unrolled but instead are inherently curved in such a way that even if there is enough space between the magazine sidewall and shell stack to receive one or more of them, their sharp side margins will dig into the shell casings and cause the magazine to jamb.

By way of further background, a special application of multi-round magazines of the type housed in the handle of the weapon has to do with the sport of rapid pistol fire, particularly as it relates to 0.45 caliber weapons. The rules require that the shooter place as many shots as possible "on target" during a predetermined timed interval. It is important, therefore, that the shooter be able to get off as many shots as he or she can before having to change magazines and also to make the change very quickly. Experts at this sport are able to eject the empty magazine and insert a new one before the empty one falls to the ground.

FIELD OF THE INVENTION

The present invention relates generally to multiple cartridge magazines, especially those housed in the handle of the weapon and which employ one or more negator springs to raise the follower. The invention also relates to one specific application of the magazine of the type aforementioned which is especially well-suited for use in 0.45 caliler rapid-fire competitions.

DESCRIPTION OF THE RELATED ART

The closest prior art known to applicant is contained in U.S. Pat. No. 4,580,364 issued to Emil Vyprachticky in which applicant is a half owner. This patent discloses a plastic rifle cartridge magazine using negator springs attached to a sidewall to raise the follower. The Chesnut U.S. Pat. No. 4,509,283 also uses a negator spring to pull the follower; however, it is mounted against an endwall as opposed to a sidewall and, therefore, rides behind the stack of cartridges rather than alongside it. In addition to the Chesnut patent, of record in the Vyprachticky patent referred to above are several other U.S. and foreign patents that employ negator springs in one way or another, specifically Hopkins U.S. Pat. No. 2,777,235; Rowe Jr. 3,399,480; Jestrabek U.S. Pat. No. 3,577,860; Hausmann U.S. Pat. No. 4,127,954; Ketterer et al U.S. Pat. No. 4,366,638; Steim's Belgian U.S. Pat. No. 635,534; and the Swiss patent to Steim Pat. No. 406,904. While all of these prior art patents use negator springs in a cartridge magazine in some fashion or another, none even recognizes, yet alone solves, the problem of the curvature inherent in this type of spring that causes it to dig into the shell casing and prevent the cartridges from feeding properly in those "in the handle" magazines which have so little space between the shell stack and magazine sidewall to house them. In simple terms, the portion of the spring unwound from the coil has a built-in concavity facing toward the coil and, therefore, the stack of cartridges located alongside thereof that is most difficult to reckon with when space is limited.

SUMMARY OF THE INVENTION

Applicant has discovered a unique solution to the vexing problems associated with pulling the follower of an "in the handle" magazine by placing one or more negator springs alongside the stack of shells as opposed to some other type of spring located underneath the follower. He accomplishes the foregoing by the simple, yet unobvious, expedient of first of all gaining some additional space alongside the stack by using thinner stock and then offsetting the sidewall to create a narrow, but nonetheless adequate, gap for the spring or springs. This, however, is but a part of the solution. In addition, the springs are sized and positioned in the gap thus created such that one incurled edge seats in the annular extractor groove at the rear end of the shell while the other curls around the bullet. By so doing, the center of the spring if it be a single one or the adjacent edges of two such springs arranged in side-by-side relation move into a position where they make only light sliding contact if any at all with the shell casings and lie instead closely adjacent the sidewall of the magazine where they do not interfere with the feeding of the shells.

It is, therefore, the principal object of the present invention to provide a novel and improved multiple cartridge magazine especially adapted for use in weapons where the magazine is housed in the handle or otherwise limited in thickness.

A second objective of the invention is to provide a magazine having a greater shell-carrying capacity than comparable magazines using helical or other type springs coiled underneath the follower as opposed to alongside it.

Another object of the invention herein disclosed and claimed is that of providing a shell magazine with a detachable bottom endplate which greatly facilitates its being cleaned.

Still another object of the within-described invention is to provide a method for preventing the shells from jamming in a multiple-round magazine or clip of the type using one or a pair of negator springs positioned alongside the stack to drive the follower.

An additional objective of the invention forming the subject matter hereof is to provide a shell magazine using one or a pair of negator springs so arranged relative to the shells that the rearmost incurled end seats in the annular extractor groove while the one at the front curls around the nose of the bullet thereby materially reducing the frictional engagement of the medial portion of a single spring or the adjacent ends of a pair thereof with the shell casings.

Further objects are to provide a magazine of the type aforementioned which is lightweight yet rugged, essentially jamproof, easy to load and unload, versatile, relatively inexpensive and readily adaptable to a wide variety of weapons, both those having magazines in the handle as well as those where it hangs underneath the receiver.

Other objects will be in part apparent and in part pointed out specifically hereinafter in connection with the description of the drawings that follows.

DESCRIPTION OF THE PREFERRED EMBODIMENTS

Figures 1, 5, 6:
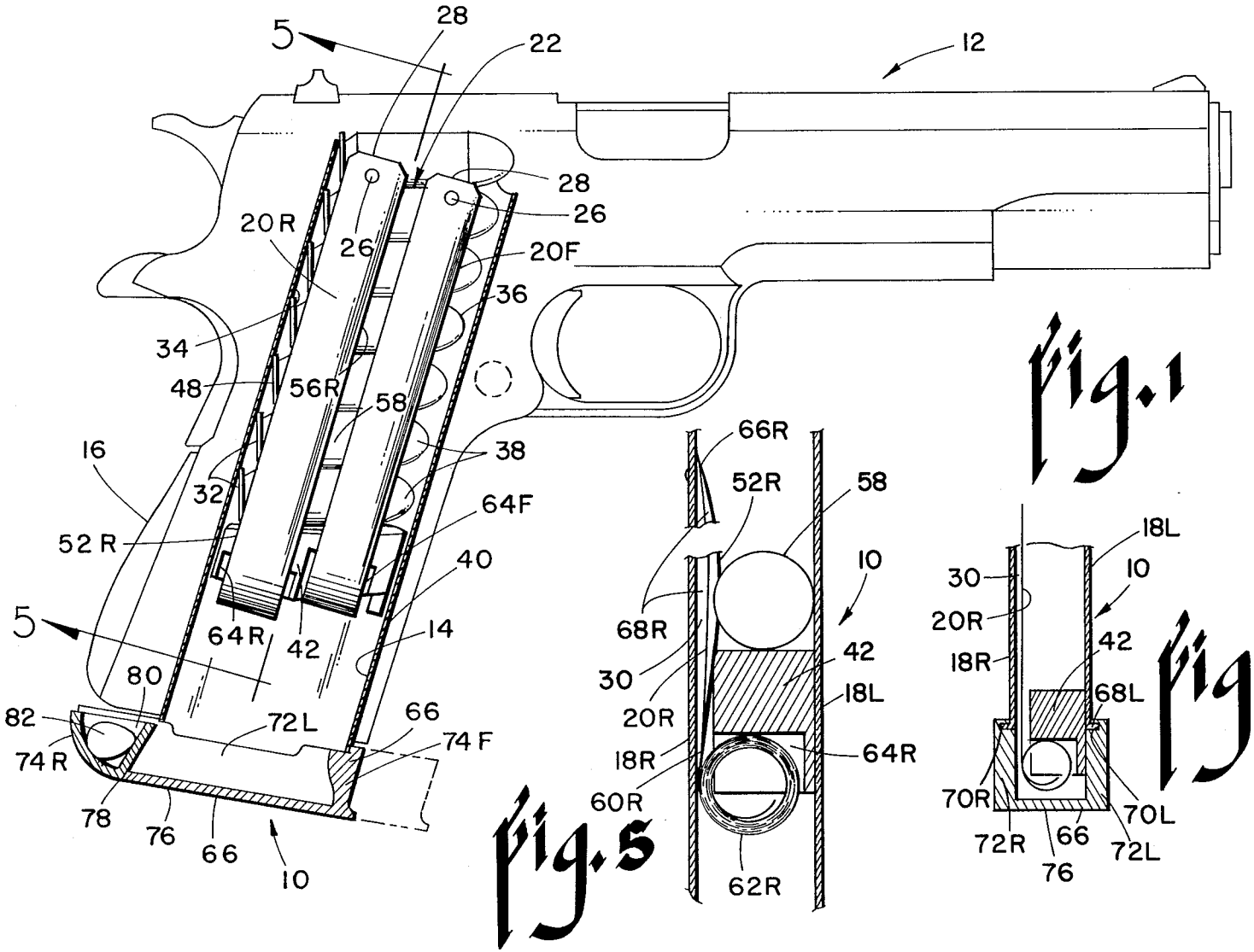
FIG. 1 is a right side elevation of a 0.45 caliber pistol with the handle broken away and shown in section to reveal the cartridge magazine of the present invention.
FIG. 5 is a section taken along line 5—5 of FIG. 1 to the same scale as FIGS. 3 and 4; and, FIG. 6 is section similar to FIG. 5, but to the reduced scale of FIGS. 1 and 2, showing the follower at the bottom of the magazine and the tongue and groove connection by means of which the endplate is detachably connected to the base of the latter.
Figures 2, 3, 4:
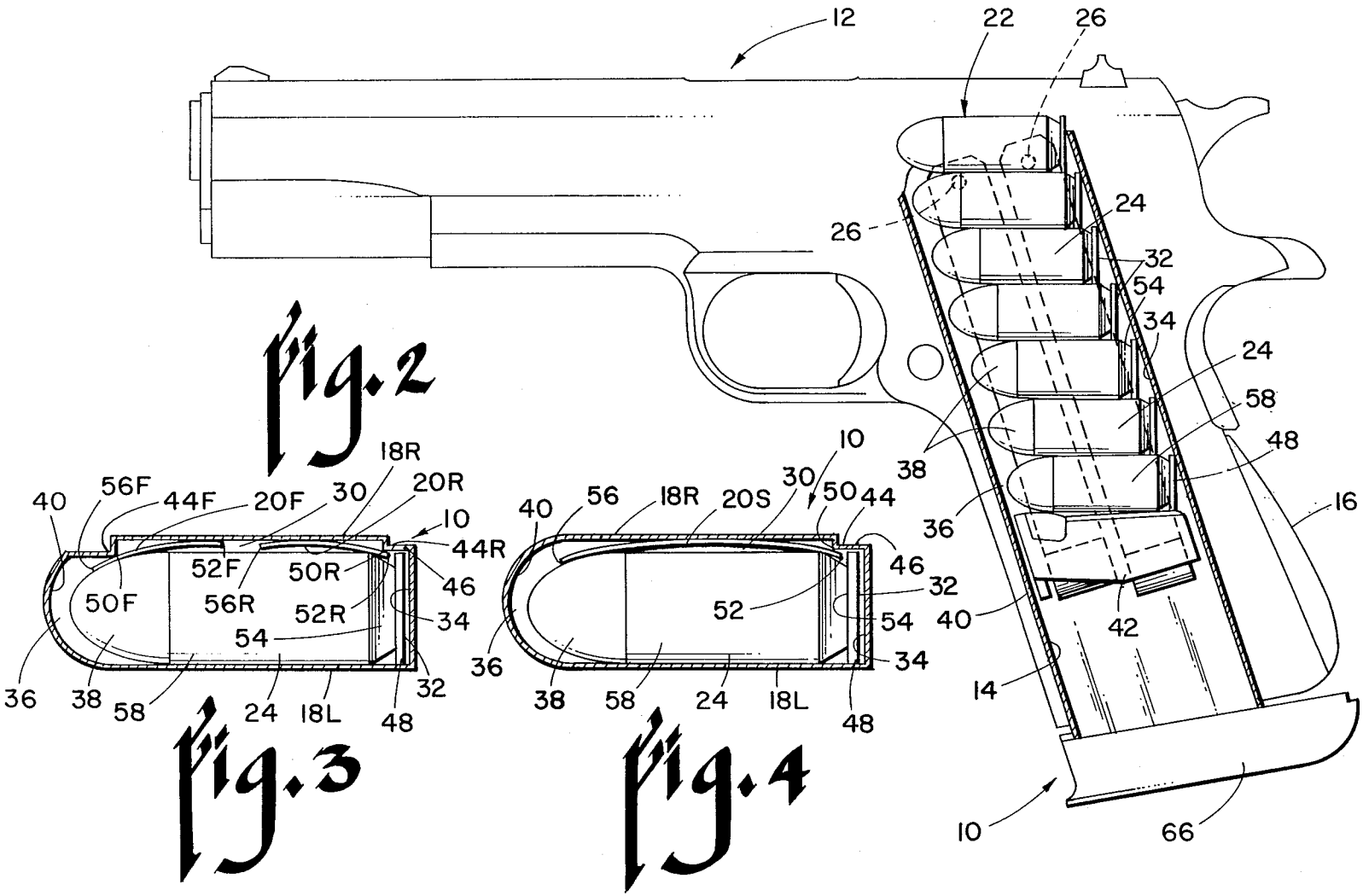
FIG. 2 is a view similar to FIG. 1 and to the same scale but differing therefrom in that it shows the left side of the weapon in elevation.
FIG. 3 is a transverse section to an enlarged scale showing how a pair of negator springs arranged in side-by-side relation have the rear end of the rear spring seated in the extractor groove of the shell while the front end of the front spring curls around the nose of the bullet.
FIG. 4 is a section much like FIG. 3 and to the same enlarged scale showing a single spring version of the magazine.

Referring next to the drawings for a detailed description of the present invention and, initially, to FIGS. 1 and 2 for this purpose, reference numeral 10 has been used to broadly designate the multiple-cartridge magazine forming the subject matter hereof while numeral 12 similarly denotes a conventional pistol, specifically, a 0.45 caliber automatic. Characteristic of this weapon is the fact that the magazine or "clip" is housed in a chamber or compartment 14 in the handle 16. This being the case, the amount of room in the chamber is fixed and the shells and magazine housing them must, of necessity, accommodate these dimensions. Moreover, the size of the shell is not a variable either, therefore, the only possible way of creating more room front to rear and side to side is to vary the thickness of the magazine walls. Of course, the length of the magazine can be increased to accommodate more cartridges but this is not a satisfactory answer.

The conventional steel magazine for a 0.45 caliber automatic pistol of the type illustrated has a wall thickness of a minimum of 0.024 inch and, more often, 0.028 inch. A 0.45 caliber shell rides so close to both sidewalls of such a magazine that there is no room left for springs to be installed alongside them. Using thinner stock would seem to be an answer so as to create more room alongside the stack of shells to accommodate one or more springs, however, this proved to be unworkable since the natural curl of the negator springs of the type shown in the previously-discussed prior art patents caused them to dig into or at least rub against the soft brass of the shell casings to an extent which the spring bias on the follower could not overcome thus causing the shells to jam. The net result has been to use helical springs or leaf springs underneath the follower thereby limiting the number of shells the clip can handle to seven or, at most, eight.

Applicant has discovered that by forming his clip 10 out of 0.018 sheet stock, preferably stainless steel, he can gain approximately 0.024 inch in width between the sidewalls 18R and 18L thereof. In the particular form shown, this 0.024 gap is all on the righthand side of the clip (See FIGS. 3 and 4) where either one negator spring 20S (FIG. 4) or, alternatively, a pair thereof 20F and 20R (FIG. 3) are placed alongside the stack 22 of individual cartridges 24. Thus, the overall width of the magazine 10 measured between the outside surfaces of its sidewalls remains the same as the conventional magazine so as to fit snugly within magazine compartment 14 while their inside surfaces are spaced apart some additional 0.024 inch or thereabout. The springs 20 together with the flat-headed rivets 26 that fasten their upper ends 28 to the right sidewall 18R of the magazine are easily accommodated in the gap 30. The rear ends 32 of the shells ride up along the rear wall 34 of the clip as shown in FIGS. 1 and 2 leaving a space 36 between the front end of the bullet 38 and the front wall 40 of the clip due, once again, to the use of thinner stock. The distance between the outside surfaces of the front and rear clip walls 34 and 40 must, of necessity, remain the same as a conventional clip so that it will fit tightly into chamber 14 and move the shells into proper position to enter the breech end of the pistol barrel. As will be seen presently, however, space 36 in front of the cartridges is no problem since the spring 20S of FIG. 4 and 20F of FIG. 3 both curl around the front end of the bullets thus tending to force them back against the rear wall 34 as does the upward pull on the follower 42 at an acute angle to the rear wall.

Certainly one of the key features of the magazine 10 is the step 44 in the right sidewall 18R located just ahead of rear wall 34 to which detailed reference will be made in connection with FIGS. 3 and 4. Springs 20 are, of course effective all by themselves to force the stack of cartridges over against left sidewall 18L as shown, therefore, the inwardly offset portion 46 of the step 44 lying closely adjacent to the right side of the cartridge rim 48 is not particularly needed for this purpose. Of far more importance is the corner 50 defined by step 44 that projects into the gap 30 between the right side of the cartridge and the right sidewall 18R since it engages the rear edge 52 of single spring 20S of FIG. 4 or the rear edge 52R of rear spring 20R of the pair thereof shown in FIG. 3 and forces whichever of the two into the annular extractor groove 54 just ahead of the rim 48. It is worthy of mention in connection with FIGS. 3 and 4 that the rear edges 52 and 52R of the springs are not shown abutting the rim but spaced slightly therefrom. Actually, these spring edges do, in fact, abut the rim but not at the point shown in FIGS. 3 or 4 since the shells are angled relative to the springs as seen most clearly in FIGS. 1 and 2.

When the rear edge 52R of the rear spring 20R of the FIG. 3 version is seated in the extractor groove 54 as shown, its front edge 56R tends to lift free of the cartridge case 58 or at least bear so lightly thereagainst that it does not impede the upward movement of the shell stack 22 under the bias exerted upon the follower 42 by the negator springs 20F and 20R. In the case of the single spring version 20S of FIG. 4, its front end 56 pressing against the rounded nose of the bullet 38 with its rear edge 52 seated in the extractor groove 54 causes the bow in the medial portion of the spring 20S to lift free of the shell casing 58 as shown. Much the same thing takes place with respect to the front spring 20F in the two spring version of FIG. 3 in that as the front end 56F curls around the nose of the bullet, its rear end 52F tends to lift free of the cartridge case wall or only bear very lightly thereagainst.

In the two spring version of FIG. 3, the magazine has been shown provided with a rear step 44R as well as a front step 44F, the latter being positioned and adapted to engage the front end 56F of the front spring 20F and hold it against the nose of the bullet thus raising the rear end thereof 52F as corner 50F bears thereagainst much in the same way as rear corner 52R does. Actually, applicant has found that the front step 44F can, in fact, be eliminated from both the single and double spring versions without adversely affecting the proper functioning of the magazine; nevertheless, there may be some instances such as, for example, less round-nosed bullets, in which two steps should be used to insure the fact that the rear edge of the front spring of the two spring version does not materially interfere with the feeding of the cartridges. Accordingly, while the two spring version has been illustrated as including two steps both front and rear, it is to be understood that only the rear one 44R is required in all but rare instances.

Looking at FIG. 5, it can be seen that the portion 60R of the spring 20R just coming off the coiled portion 62R seated in the pocket 64R of the follower 42 is quite flat as is the portion 66R at the top fastened to the right sidewall by the rivet 26, however, the medial portion 68R free of such restraints is substantially curved and has a concavity therein facing the coil. Obviously, it is the cartridges in the medial portion of the spring that must accommodate this curvature in the manner previously described, those nearest the coil and at the top having little tendency to bind up due to the springs frictionally engaging the brass shell casings.

In FIGS. 1, 2, 5 and 6, the follower 42 can be seen to be much like that of the Vyprachticky patent previously mentioned in that it has a rear spring coil pocket 64R opening toward the right sidewall 18R as well as toward the bottom of the magazine and a front pocket 64F doing likewise. The follower (not shown) for the single spring version of FIG. 4, of course, has only a single wide pocket instead of the two. Regardless of whether the follower contains one pocket or two, it is shown sized in FIG. 6 such that as it approaches the bottom of the magazine where detachable endplate 66 is located, only approximately a single coil of the spring is left uncoiled. This, of course, minimizes the size of the coil and permits the follower to move very close to bottoming-out atop the endplate. Thus, the spring coil takes up little, if any, room beneath the follower which is not true of the magazines having helical or leaf springs stacked therebeneath. This enables extra cartridges to be loaded into the clip without having to make it any longer. For instance, the one shown in FIGS. 1 and 2 has a nine-shell capacity as opposed to seven for most of the others.

Finally, with particular reference to FIGS. 1 and 6, it can be seen that the lower marginal edges of the right and left sidewalls 18R and 18L, respectively, are provided with outturned flanges 68R and 68L. These flanges cooperate to define rails for the opposed grooves 70R and 70L in the sidewalls 72R and 72L of the endplate to slide along and form a tongue and groove connection. These sidewalls are joined together front and rear by endwalls 74F and 74R, respectively, and along the bottom by bottom wall 76. A transverse partition wall 78 cooperates with the bottom wall and rear endwall in the particular form shown to produce an upwardly-opening pocket 80 (FIG. 1) into which may be inserted a lead weight 82 or the like which functions upon pressing magazine release button (not shown) to make the magazine drop out of compartment 14 in the handle more quickly thus facilitating replacement thereof with a fresh magazine which is especially useful in rapid-fire competitions.

Sliding the endplate 66 from its full line position shown in FIGS. 1 and 2 toward the phantom line position of FIG. 1 permits the latter to be removed provided, of course, that at least one shell has been removed from the magazine so that the follower 42 will be raised up to a position in the handle where it will not interfere with its removal. Also no spring is pressing against the endplate to keep it from being removed which is the case with many of the prior art magazines. Once removed, the magazine can be cleaned and otherwise refurbished to prevent the shells contained therein from jamming. As is the case with most all such magazines, it can be reused by reloading the shells one-at-a-time from the top.

The above-described clip or magazine of the "in the handle" type possesses many distinct and worthwhile advantages not found in the prior art ones including those having negator springs driving the follower. Especially advantageous is its ability to hold extra shells without increasing its length appreciably and, most significant, the fact that the jamming problem resulting from the inturned edges of the springs digging into the soft brass of the shell casings has been eliminated. It is significant to note that while the invention forming the subject matter hereof has been illustrated in connection with a magazine designed to carry a single row of shells, it is equally well-suited for use in those having a double-row configuration, whether staggered or side-by-side, since every other shell in the row nearest the sidewall having the spring or springs attached thereto in even the staggered arrangement will have an extractor groove to receive the rearmost spring edge as well as a rounded or otherwise tapered nose for the foremost spring edge to curl around.

What is claimed is:

1. In a multiple-round cartridge magazine including spaced sidewalls and endwalls cooperating to define an open-topped chamber adapted to retain in stacked relation a plurality of cartridges of the type having a bullet with a rounded or otherwise tapered nose on the front end thereof and an annular groove adjacent its rear end, a follower positioned within the chamber underneath the stack for feeding the cartridges thereabove one-at-a-time out through the open top, and at least one negator spring having an upper end attached to one of the sidewalls of the chamber alongside the stack near the top thereof and its other end coiled underneath the follower, and wherein the aforesaid spring or springs upon retraction of the follower producing an uncoiled portion located alongside the stack which has a transversely-extending curve therein so shaped that the front and rear edges thereof cooperate with the medial portion to define a concavity opening toward the stack, the improvement which comprises: offsetting said one wall so as to leave an oversized gap for the spring or springs alongside the stack, positioning and sizing the spring or springs relative to the stack such that the rear edge of one spring lies adjacent the annular grooves in the rear ends of the cartridges and the front edge of the same or another spring curls around the nose of the bullet, and providing said one sidewall with abutment-forming means projecting into the gap aligned with the annular grooves of the cartridges in the stack, said abutment-forming means being so designed and positioned as to engage and hold said rear edge lying adjacent the annular grooves in the cartridges seated within the latter, said front and rear edges when so located cooperating with one another to lessen the pressure exerted by any other portion of the spring or springs against the sides of the cartridges in the stack to the degree which allows the follower to raise them freely up through the chamber.

2. The improved multiple-shell cartridge magazine as set forth in claim 1 wherein: the abutment-forming means comprises a step formed in the corner between the rear wall of the chamber and the said one wall thereof.

3. The improved multiple-shell cartridge magazine as set forth in claim 1 wherein: a second abutment-forming means is provided on the inside of the one sidewall positioned and adapted to engage said front edge and hold same against the nose of the bullet.

4. The improved multiple-shell cartridge magazine as set forth in claim 3 wherein the second abutment-forming means comprises a second step formed in the corner between the front wall of the chamber and the said one wall thereof.

5. The method for preventing the cartridges from jamming in a multiple-shell cartridge magazine of the type using one or a pair of transversely-curved negator springs fastened to a sidewall alongside the shell stack to lift the latter by means of a follower located therebeneath where each of the shells is encircled at its rear end by an annular groove and has a rounded or otherwise tapered bullet at its front end, which comprises: positioning the rearmost incurled edge of the spring or springs within the annular grooves in the shells while permitting the foremost incurled edge to curl around the bullets thereby lessening the frictional contact between casings of the shells in the shell stack and the medial section of a single spring or the adjacent ends of a pair thereof.

6. The method as set forth in claim 5 in which: the rearmost spring edge is forceably held within the annular grooves.

7. The method as set forth in claim 5 in which: the foremost spring edge is forceably held against the noses of the bullets.

8. The method as set forth in claim 6 in which: the foremost spring edge is forceably held against the noses of the bullets.

9. In a multiple-round cartridge magazine including spaced sidewalls and endwalls cooperating to define an open-topped chamber adapted to retain in stacked relation a plurality of cartridges of the type having a bullet with a rounded or otherwise tapered nose on the front end thereof, a follower positioned within the chamber underneath the stack for feeding the cartridges thereabove one-at-a-time out through the open top, and a negator spring having an upper end attached to one of the sidewalls of the chamber alongside the stack near the top thereof and its other end coiled underneath the follower, and wherein the aforesaid spring upon extension of the follower produces an uncoiled portion located alongside the stack which has a transversely-extending curve therein so shaped that the front and rear edges thereof cooperate with the medial portion to define a concavity opening toward the stack, the improvement which comprises: positioning the spring relative to the stack such that the front edge thereof twists and curls around the nose of the bullet, said front edge when so located being effective to lessen the pressure exerted by the rear edge thereof or any other portion of the spring against the sides of the cartridges in the stack to the degree which allows the follower to raise them freely up through the chamber.

10. The method for preventing cartridges from jamming in a multiple-shell cartridge magazine of the type using transversely-curved negator springs fastened to a sidewall alongside the shell stack to lift the latter by means of a follower located therebeneath where each of the shells has a rounded or otherwise tapered bullet at its front end, which comprises: positioning the foremost incurled edge to twist and curl around the bullets thereby lessening the frictional contact between casings of the shells in the shell stack and the rearmost incurled edge of said spring.

* * * * *